US008322445B2

(12) United States Patent
Khomynets

(10) Patent No.: US 8,322,445 B2
(45) Date of Patent: Dec. 4, 2012

(54) WELL JET DEVICE

(76) Inventor: Zinoviy Dmitrievich Khomynets, Moscow (RU)

( * ) Notice: Subject to any disclaimer, the term of this patent is extended or adjusted under 35 U.S.C. 154(b) by 180 days.

(21) Appl. No.: 12/667,522

(22) PCT Filed: Mar. 19, 2008

(86) PCT No.: PCT/RU2008/000156
§ 371 (c)(1),
(2), (4) Date: Dec. 31, 2009

(87) PCT Pub. No.: WO2009/011610
PCT Pub. Date: Jan. 22, 2009

(65) Prior Publication Data

US 2011/0000661 A1 Jan. 6, 2011

(30) Foreign Application Priority Data

Jul. 18, 2007 (RU) ..... 2007127449

(51) Int. Cl.
*E21B 43/00* (2006.01)

(52) U.S. Cl. ..... 166/372; 417/172
(58) Field of Classification Search ..... 417/172; 166/68, 302, 369, 370, 372
See application file for complete search history.

(56) References Cited

U.S. PATENT DOCUMENTS

2004/0071557 A1 4/2004 Khomynets
2006/0027377 A1 * 2/2006 Schoonderbeek et al. .... 166/386

FOREIGN PATENT DOCUMENTS

| | | | |
|---|---|---|---|
| RU | 2059891 | C1 | 5/1996 |
| RU | 2106540 | C1 | 3/1998 |
| RU | 2160364 | C1 | 12/2000 |
| RU | 2188970 | C1 | 9/2002 |
| WO | 02/081928 | A1 | 10/2002 |

* cited by examiner

*Primary Examiner* — William P Neuder
*Assistant Examiner* — Ronald Runyan
(74) *Attorney, Agent, or Firm* — patenttm.us

(57) ABSTRACT

For extracting oil from wells, pipe string, packer with axial through hole and support with axial channel with seat for jet pump mounting. Bypass channel with return valve is in support wall. Pump has cylindrical body with annular shoulder, for support seat mounting. Body has channel for supplying active medium to the pump nozzle, channels for supplying pumped out medium and removing media mixture and through channel with sealing unit. The channel couples to unit downstream channel. The unit has axial channel passing and displacing a logging cable/instrument. Mixing chamber with diffuser connected to the pipe string cavity upstream of pump positions axially to the nozzle. Channel diameter of support downstream of seat is equal to or greater than packer hole. The invention makes it possible to extend the device functionalities due to the possibility of disconnecting the in-tube space and casing annulus when the pump is stopped.

1 Claim, 2 Drawing Sheets

WELL JET DEVICE

FIELD OF THE INVENTION

This invention relates to the field of pump engineering and in particular to well jet devices for producing oil from wells.

BACKGROUND OF THE INVENTION

A well jet device is known, which comprises a pipe string with a jet pump installed on the flow string in a well and a geophysical instrument arranged below the jet pump in the flow string (see: RU Patent No. 2059891 C1, FO4F 5/02, 10.05.1996).

This known device enables to pump a variety of produced media, e.g., oil, out of a well, while simultaneously treating a produced medium and the formation near-well area, but this device provides for supplying an operating fluid into the nozzle of the jet pump via the pipe string, which a number of cases narrows the field of use of this device.

The closest to the invention as to the technical essence and the achieved result is a well jet device comprising a packer, a pipe string with a support wherein drain openings are made and whereon a jet pump is installed in the body of which a channel for supplying an active fluid to the nozzle of the jet pump, a channel for supplying a medium pumped out of a well and a channel for removing a medium mixture from the jet pump are made, and a through channel with a mounting seat for installing a sealing unit is made in the body above the channel for supplying a pumped out medium. An axial channel is made in the sealing unit with the possibility of passing a logging cable through it and through the channel for supplying a pumped out medium, which logging cable is used for installing bottomhole instruments on it and below the jet pump with the possibility of moving them along the well hole when the jet pump is or is not in operation, the channel for supplying an active medium to the jet pump nozzle being in communication with the drain openings and, through the latter, with the space surrounding the pipe string, and the channel for removing a medium mixture being in communication with the inner cavity of the pipe string above the jet pump (see: RU Patent No. 2188970, F04F 5/54, 10.09.2002).

The above well jet device enables to carry out various process operations in a well below the jet pump installation level, also when a pressure differential above and below the sealing unit exists. But this device does not enable to use its possibilities to the fullest extent due to the impossibility of pumping chemical reagents to a producing formation with the use of the jet pump without preliminarily installing a special insert, which separates the pipe inner space and the annular space in the jet-pump through channel; and, consequently, the functional capabilities of the well jet device are reduced.

SUMMARY OF THE INVENTION

The objective of this invention is to develop a well jet device with the possibility of separating the pipe inner space and the annular space when a jet pump is not in operation.

The technical effect of using the proposed well jet device consists in expanding the functional capabilities of the well jet device.

The stated technical problem can be solved, and the technical effect can be achieved, due to the fact that the proposed well jet device comprises a pipe string provided with, from bottom to top, a packer with an axial through opening and a support with an axial channel having a mounting seat intended for installing a jet pump on it, wherein the support wall includes a drain channel with a check valve, and the jet pump includes a cylindrical housing which outer surface is provided with an annular shoulder intended for installing the jet pump onto the mounting seat in the support, and the housing is provided with a channel for supplying an active fluid into the nozzle of the jet pump, a channel for supplying a medium pumped out of a well into the jet pump, a channel for removing a medium mixture from the jet pump, and a through channel with a sealing unit installed in its upper part, the through channel being connected to the channel for supplying a medium pumped out of a well below the sealing unit, the sealing unit having an axial channel for passing a logging cable intended for installing a logging instrument for measuring physical parameters of a well, e.g., pressure and temperature, and treating producing formations, e.g., with ultrasound, through that channel, with the possibility of moving the said instrument along the well hole when the jet pump is or is not in operation, and the channel for supplying an active fluid into the nozzle of the jet pump being connected to the support through channel and, via the latter, to the space surrounding the pipe string, a mixing chamber with a diffuser being in alignment with the nozzle, and the diffuser outlet being connected to the pipe inner cavity above the jet pump via the channel for removing a medium mixture from the jet pump, and the diameter of the support axial channel below the mounting seat is not less than the diameter of the axial through opening in the packer.

An analysis of operation of the proposed well jet device shows that there exists the possibility of expanding the functional capabilities of the well jet device through enlarging a range of operations that may be carried out in a well without lifting the jet pump up to the surface and without installing additional equipment on the jet pump.

The proposed well jet device enables to create several differential pressure drawdown values at a given differential pressure and use a logging instrument for registering pressure, temperature and other physical parameters of a well itself and a medium pumped out of it, surveying and testing a well, and register a formation pressure-restoration curve in the under-packer space of a well without using a special functional insert. However, in a number of cases where only a survey is conducted or a producing formation is treated with the use of a logging instrument, e.g., in a case of treating a producing formation with physical fields, in particular with ultrasound, it is insufficient for intensifying an inflow from a producing formation. Providing the support wall with a through channel having a check valve, in combination with making the diameter of the support through channel below the mounting seat not less than the diameter of the axial through opening of the packer, enables to supply chemical reagents or a hydrofracturing fluid via the pipe string without using any additional tools or functional inserts on the pipe string and improve the work efficiency, and the check valve prevents a medium pumped into a producing formation from entering into the well annular space above the packer during pumping operations. The above-said relation between the diameters of the support axial channel and the axial through opening of the packer is very important. Making the diameter of the support axial channel not less than the diameter of the axial through opening of the packer is necessary for obtaining the possibility of lowering a logging instrument into the well under-packer area for the purposes of treating a formation with physical fields (treating with ultrasound or creating, e.g., a thermal field) and reducing hydraulic resistance both when pumping various media into a producing formation and for pumping treatment products and a produced medium out of a producing formation after a differential pressure drawdown on such a producing formation is created. At the same time, it becomes possible to monitor a differential pressure drawdown value by controlling the rate of supplying an active operating fluid. During testing formations it is possible to adjust pumping modes by changing the pressure of an active operating fluid supplied to the active nozzle of the jet pump. Also, a spontaneous backflow of an operating fluid into the under-packer area is precluded both when the jet pump is operated and is not operated.

Through creating pulsed differential pressure drawdown on producing formations in combination with acting on producing formations with, e.g., ultrasound fields created by a bottomhole instrument it is possible to carry out works on intensifying an inflow from producing formations.

DESCRIPTION OF THE PREFERRED EMBODIMENT

Figure 1:
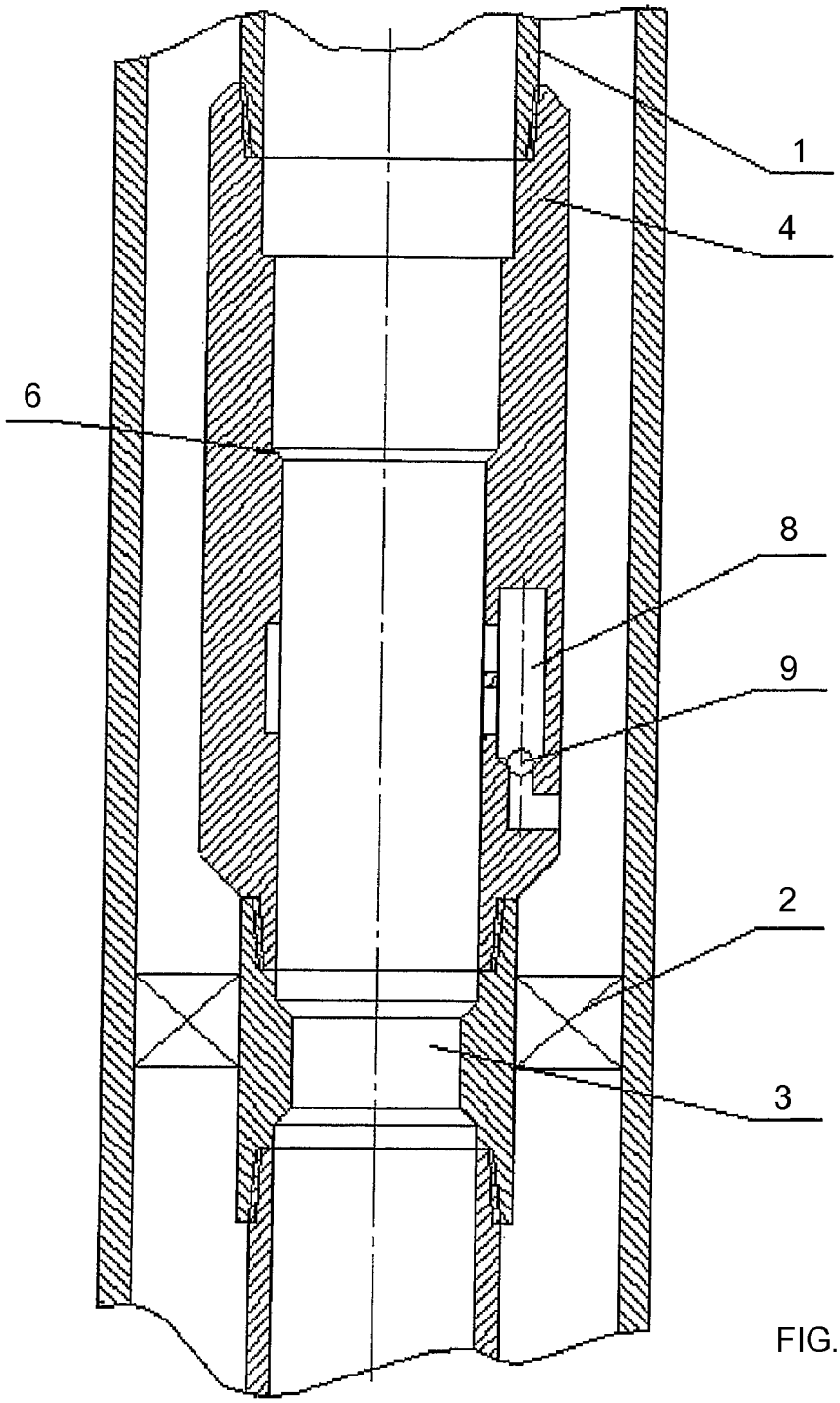
FIG. 1 shows a longitudinal section of the proposed well jet device during pumping chemical reagents or a hydrofracturing fluid into a producing formation.
Figure 2:
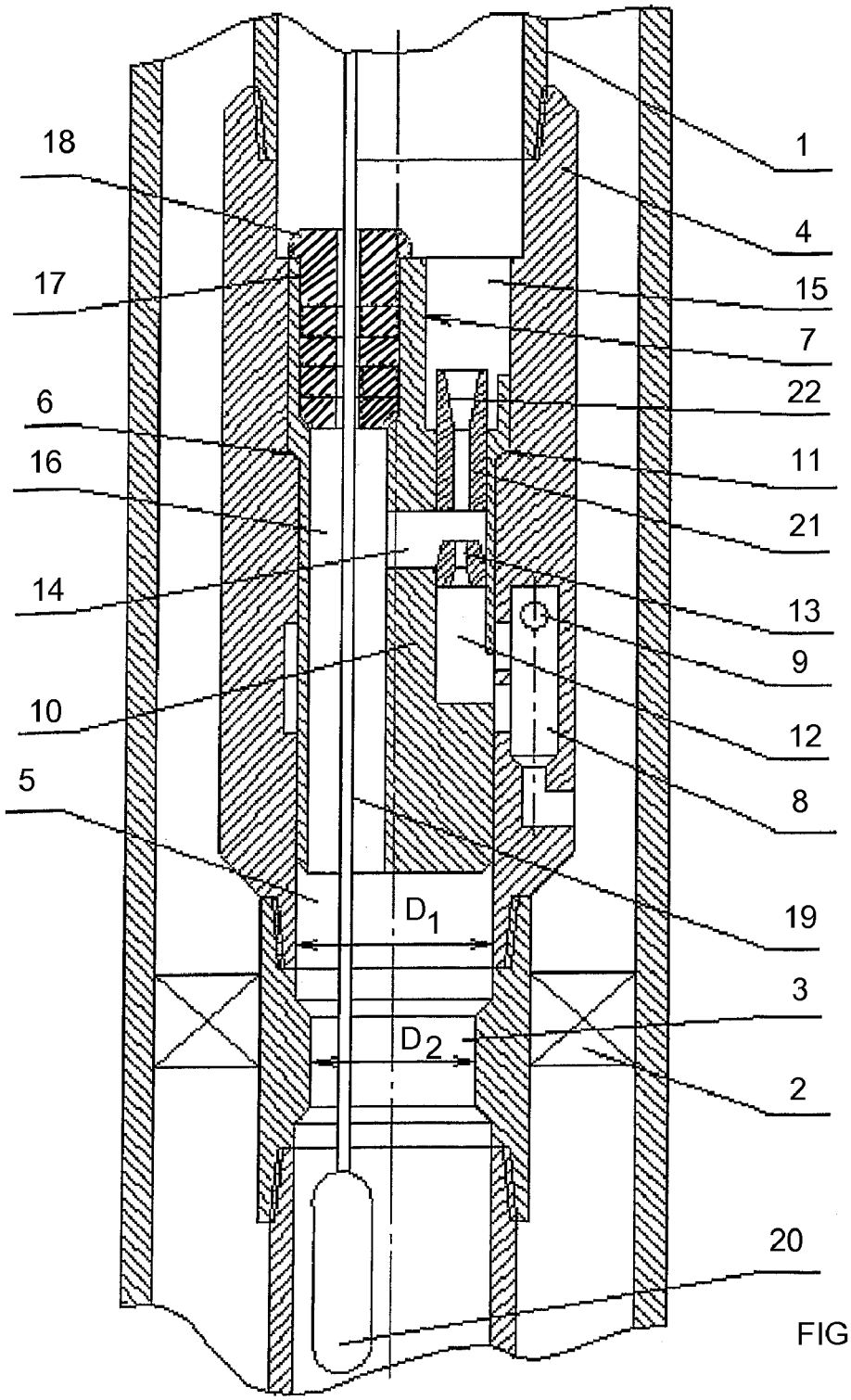
FIG. 2 shows a longitudinal section of the proposed well jet device during operation of a well jet pump.

The proposed well jet device comprises a pipe string 1 provided with, from bottom to top, a packer 2 with an axial through opening 3 and a support 4 with an axial channel 5 having a mounting seat 6 intended for installing a jet pump 7 on it. The support wall 4 includes a drain channel 8 with a check valve 9, and the jet pump 7 includes a cylindrical housing 10 which outer surface is provided with an annular shoulder 11 intended for installing the jet pump 7 onto the mounting seat 6 in the support 4, and the housing 10 is provided with a channel 12 for supplying an active fluid into the nozzle 13 of the jet pump 7, a channel 14 for supplying a medium pumped out of a well into the jet pump 7, a channel 15 for removing a medium mixture from the jet pump 7, and a through channel 16 with a sealing unit 17 installed in its upper part. The through channel 16 is connected to the channel 14 for supplying a medium pumped out of a well below the sealing unit 17. The sealing unit has an axial channel 18 for passing a logging cable 19 intended for installing a logging instrument 20 for measuring physical parameters of a well, e.g., pressure and temperature, and treating producing formations, e.g., with ultrasound, through that channel, with the possibility of moving the said instrument along the well hole when the jet pump 7 is or is not in operation. The channel 12 for supplying an active fluid into the nozzle 13 of the jet pump 7 is connected to the through channel 8 of the support 4 and, via the said channel 8, to the space surrounding the pipe string 1. A mixing chamber 21 with a diffuser 22 is in alignment with the nozzle 13. The diffuser outlet is connected to the pipe inner cavity above the jet pump via the channel 15 for removing a medium mixture from the jet pump 7, and the diameter D1 of the axial channel 5 of the support below the mounting seat 6 is not less than the diameter D2 of the axial through opening 3 in the packer 2.

The pipe string 1 is lowered into a well together with the packer 2 and the support 4, and the packer 2 is arranged over a producing formation (not shown). The packer 2 is brought into its operative position, thus separating the well space surrounding the pipe string 1. A hydrofracturing fluid or an acid solution is supplied under pressure via the pipe string 1 to the producing formation, after which and the jet pump 7 is lowered into the pipe string 1 together with the sealing unit 17, as installed in the through channel 16, and the logging instrument 20 arranged on the logging cable 19 below the body 10 of the jet pump 7. The body 10 of the jet pump 7 is installed on the mounting seat 6. An operating (active) fluid, e.g., water, a salt solution, oil, etc., is pumped into the annular space surrounding the pipe string 1. The operating fluid comes through the drain channel 8 and the check valve 9 into the channel 12 for supplying an active fluid into the nozzle 13 of the jet pump 7. Within a few seconds after pumping the operating fluid through the nozzle 13 a stable jet is formed at its outlet, which, while exiting the nozzle 13, draws a surrounding medium into the mixing chamber 21, which results in a reduced pressure first in the channel 14 for supplying a pumped out medium and then in the well under-packer space also. A value for which pressure is reduced depends on the flow rate of the operating (active) fluid in the nozzle 13, and the flow rate, in its turn, depends on supply pressure of the operating (active) fluid through the well annular space above the packer 2. Then, the hydrofracturing fluid or products of chemical treatment of the producing formation are pumped out of the producing formation, and then a formation fluid is pumped out of the producing formation and comes to the mixing chamber 21 via the pipe string 1, the through channel 16 and the channel 14 for supplying a pumped out medium, where it is mixed with the operating (active) fluid, and into the diffuser 22. Then the mixture comes from the well to the surface through the pipe string 1 due to the energy of the operating (active) fluid. During pumping out of a formation fluid the logging instrument, as installed on the cable 19, is used for monitoring parameters of the pumped out fluid as well as for acting on the producing formation with physical fields, e.g., with ultrasound fields, for the purpose of intensifying an inflow from the producing formation. According to a specific task, it is possible to move the logging instrument 20 along the well hole. At the same time, several values of differential pressure drawdown on the producing formation are created by changing the pressure of the operating (active) fluid, and parameters of the pumped out fluid inflow from the producing formation are registered with the use of the logging instrument 20. After the well survey and the treatment of the producing formation are completed, the logging instrument 20 is lifted up with the use of the logging cable 19, is used for acting on the housing 10 of the jet pump 7. Then the jet pump 7 is extracted from the well with the use of the logging cable 19, and the well is transferred into the operation mode.

INDUSTRIAL APPLICABILITY

The proposed invention may be used for testing, developing and operating oil and gas-condensate wells as well as during well-workover operations.

What is claimed is:

1. A well jet device comprising: a pipe string provided with, from bottom to top, a packer with an axial through opening in a packer's body and a support with an axial channel having a mounting seat intended for installing a jet pump on it, wherein a diameter of the axial channel above the mounting seat being larger than that below the mounting seat, wherein the support wall includes a drain channel with a check valve, wherein the drain channel being connected with the axial channel via an annular groove, the annular groove being disposed in the inner wall of the axial channel below the mounting seat, and a jet pump includes a cylindrical housing which outer surface is provided with an annular shoulder intended for installing the jet pump onto the mounting seat in the support; the housing is provided with a channel for supplying an active fluid into the nozzle of the jet pump, a channel for supplying a medium pumped out of a well into the jet pump, a channel for removing a medium mixture from the jet pump, and a through channel with a sealing unit installed in its upper part, the through channel being connected to the channel for supplying a medium pumped out of a well below the sealing unit, the sealing unit having an axial channel for passing a logging cable intended for installing a logging instrument for measuring physical parameters of a well, e.g., pressure and temperature, and treating producing formations, e.g., with ultrasound, through that channel, with the possibility of moving the said instrument along the well hole when the jet pump is or is not in operation, and the channel for supplying an active fluid into the nozzle of the jet pump being connected to the support through channel and, via the latter, to the space surrounding the pipe string, a mixing chamber with a diffuser being in alignment with the nozzle, and the diffuser outlet being connected to the pipe inner cavity above the jet pump via the channel for removing a medium mixture from the jet pump, and the diameter of the support axial channel below the mounting seat is not less than the diameter of the axial through opening in the packer's body.

* * * * *